US008715027B2

(12) United States Patent
Limin et al.

(10) Patent No.: US 8,715,027 B2
(45) Date of Patent: May 6, 2014

(54) INFLATABLE PINATA

(76) Inventors: Michael Limin, San Luis Obispo, CA (US); Reid Ellison Tattersall, West Lake, CA (US); Preston Tyler Sutter, McKinleyville, CA (US); Christian Alejandro Carrillo, Chula Vista, CA (US); Jagjit Singh, San Luis Obispo, CA (US); Ogonna C. Agu, Hemet, CA (US)

( * ) Notice: Subject to any disclaimer, the term of this patent is extended or adjusted under 35 U.S.C. 154(b) by 367 days.

(21) Appl. No.: 13/019,192

(22) Filed: Feb. 1, 2011
(Under 37 CFR 1.47)

(65) Prior Publication Data

US 2012/0028531 A1 Feb. 2, 2012

Related U.S. Application Data

(60) Provisional application No. 61/300,949, filed on Feb. 3, 2010.

(51) Int. Cl.
*A63H 27/10* (2006.01)

(52) U.S. Cl.
USPC ..... 446/5; 446/200

(58) Field of Classification Search
USPC ..... 446/5, 220
See application file for complete search history.

(56) References Cited

U.S. PATENT DOCUMENTS

| | | | | |
|---|---|---|---|---|
| 3,771,247 | A * | 11/1973 | De Harak | 40/736 |
| 4,569,082 | A * | 2/1986 | Ainsworth et al. | 383/3 |
| 4,837,955 | A * | 6/1989 | Grabhorn | 40/214 |
| 5,263,889 | A * | 11/1993 | Ledonne | 446/5 |
| 6,435,935 | B1 * | 8/2002 | Komaba | 446/220 |

* cited by examiner

*Primary Examiner* — Alvin Hunter
*Assistant Examiner* — Amir Klayman
(74) *Attorney, Agent, or Firm* — Stephen C. Beuerle; Procopio Cory Hargreaves & Savitch LLP

(57) ABSTRACT

An expandable piñata including a body having a front wall, a rear wall, a left side portion, a right side portion, a top portion, and a bottom portion that define an interior cavity of the piñata; one or more pouches coupled to each of the front wall, back wall, left side portion, and right side portion; and a valve coupled to the body and configured for selectively inflating and deflating the interior cavity, the body being inflatably and deflatably adjustable between a first, substantially flat configuration, and a second expanded configuration.

17 Claims, 4 Drawing Sheets

INFLATABLE PINATA

CROSS REFERENCE TO RELATED APPLICATION

This application claims the benefit of U.S. provisional patent application 61/300,949 filed Feb. 3, 2010 under 35 U.S.C. 119. U.S. provisional patent application 61/300,949 is incorporated by reference herein as though set forth in full.

FIELD OF THE INVENTION

The field of the invention relates, in general, to piñatas, and, in particular, to expandable piñatas.

BACKGROUND OF THE INVENTION

Piñatas are popular, especially among children, at parties and other festive occasions. Piñata-breaking celebrations are quite popular in Mexico and in the Mexican-American communities of the Southwestern United States. Piñatas are traditionally a pot or container ornamented with colorful paper and filled with candy, nuts, confetti, and/or token gifts such as small toys and the like. The container is suspended from above and the children, while blindfolded, take turns attempting to puncture the container with a bat or other implement to release the treats within. The traditional piñata is made of clay pottery. More recently, piñatas are constructed of paper mache or other frangible material and generally include a bottom paper closure which is torn or broken by the child pulling a cord or similar attachment secured to the closure, or otherwise breaking the closure.

Typical mass-produced piñatas are constructed of paper mache and assume their full form prior to shipping. The piñata may be filled with treats, but are more commonly sold empty. The hollow paper mache construction of the piñata is relatively fragile and susceptible to breakage during shipping and handling.

A general problem with piñatas in the past is that their large and unusual sizes make shipping expensive.

A need exists for an expandable piñata that may be shipped in a small, flat, two-dimensional configuration and may later be expanded into a large piñata for use at the party or other festive occasion.

SUMMARY OF THE INVENTION

To overcome the above problems and others, an aspect of the invention involves an expandable and collapsible piñata. The piñata is collapsible for reducing the piñata to a small, compact, flat, substantially two-dimensional configuration that is ideal for shipping because of the greatly reduced shipping costs. The piñata is quickly and easily expandable into a large piñata configuration for normal piñata use at a party or other festive occasion.

Another aspect of the invention involves a piñata that is far more marketable than traditional piñatas because of their huge increase in size at their point of sale. The piñata's size can be reduced greatly when it is getting shipped, and then include a method of expanding it via minimum assembly by either the Point of Sale or the end consumer. The amount of increase is unmatched, and the end product resembles the "true" size of what a piñata should be, not the tiny piñatas that are currently available for mass distribution. This greatly reduces the shipping cost and incorporates many innovative aspects. The heart of this invention is the ability to provide a 3D piñata with a look and size that resembles traditional piñatas while overcoming the caveats posed by high shipping costs via size reduction at the time of transport.

The invention will overcome high shipping costs associated with shipping piñatas of a more traditional size while staying truer to the shapes and feel of what is known as a piñata by most Hispanic peoples. Because shipping costs are a necessary part to any mass distributed piñata operation, industry participants have to deal with the shipping costs in one way or another. Current industry solutions include making/selling smaller piñatas as well as a two-dimensional looking piñatas that does provide some expandability but lacks the complete feel, size, and three-dimensional shape of what is traditionally known as a piñata. The two-dimensional shape addresses the shipping size issue but it merely provides a flat surface on which to apply a large sticker.

The invention, which greatly reduces costs, greatly increases size, and significantly improves enjoyment, will revolutionize the piñata industry and will help spread the piñata culture all across the globe. Large retailers, party suppliers, as well as end consumers will replace their current purchase choices for the money saving, size increasing, enjoyment improving option created by the invention. Shipping goes from being a problem to being a selling point. The invention also makes it possible to improve the current speed, quality control, and cost at which piñatas are actually made, let alone distributed. The mechanisms which allow the piñatas to increase in size also imply and require a new methodology for manufacturing the piñatas which may help with these other considerations (cost of production, speed of production, quality control) inherent in the process of taking raw materials to a finished product in the consumer's home.

The invention embodies the small advantageous size for shipping, the large desirable size for usage, and the three-dimensional feel for enjoyment and authenticity.

Another aspect of the invention involves an expandable piñata including a body having a front wall, a rear wall, a left side portion, a right side portion, a top portion, and a bottom portion that define an interior cavity of the piñata; one or more pouches coupled to each of the front wall, back wall, left side portion, and right side portion; and a valve coupled to the body and configured for selectively inflating and deflating the interior cavity, the body being inflatably and deflatably adjustable between a first, substantially flat configuration, and a second expanded configuration.

One or more implementations of the aspect of the invention described immediately above include one or more of the following. The top portion comprises a joinder flange. The joinder flange comprises a hole for receiving a support for suspending the piñata. The body comprises polyethylene. The body comprises polyvinyl chloride. The left side and right side portions each comprise a longitudinal central seam. The valve is configured to selectively receive and emit a gas. The valve is configured to selectively receive and emit a liquid. The expandable piñata includes one or more ornamental layers of material coupled to the body. The expandable piñata includes one or more ornamental layers of material coupled to one or more the one or more pouches. The expandable piñata includes one or more reinforcing layers of material coupled to the body.

A further aspect of the invention involves a method of manufacturing an expandable piñata including forming a body from one or more pieces of material, the body comprising a front wall, a rear wall, a left side portion, a right side portion, a top portion, and a bottom portion that define an interior cavity of the piñata; coupling one or more pouches to each of the front wall, back wall, left side portion, and right side portion; and coupling a valve to the body, the valve being configured to inflate and deflate the interior cavity, the body being inflatably and deflatably adjustable between a first, substantially flat configuration, and a second expanded configuration.

One or more implementations of the aspect of the invention described immediately above include one or more of the following. The body is formed of a single piece of material. The body comprises forming a joinder flange on the top portion of the body. The method includes forming a hole in the joinder flange for receiving a support for suspending the piñata. The body comprises polyethylene. The body comprises polyvinyl chloride. Forming the body comprises forming a longitudinal central seam on the left and right side portions. Coupling one or more ornamental or supporting layers of material coupled to the body.

A still further aspect of the invention involves an expandable piñata including a body comprising a front wall, a rear wall, a left side portion, a right side portion, a top portion, and a bottom portion that define an interior cavity of the piñata; means for attaching a support for suspending the body; means for supporting articles on the exterior of the body; and means for inflating and deflating the interior cavity.

DETAILED DESCRIPTION OF PREFERRED EMBODIMENT OF THE INVENTION

With reference to FIGS. 1-6, embodiment(s) of an inflatable, expandable piñata ("piñata") 100 will be described. The piñata 100 is collapsible for reducing the piñata to a small, compact, flat, substantially two-dimensional configuration for shipping (minimizes shipping costs) and inflatable/expandable to a large piñata configuration (FIG. 1) for piñata use at a party or other festive occasion. In alternative embodiments, the piñata 100 may have configurations, shapes, characters, and/or designs other than that shown and/or described herein.

The piñata 100 will first be described generally and then a method of manufacturing the piñata 100 will be described.

Figure 1:
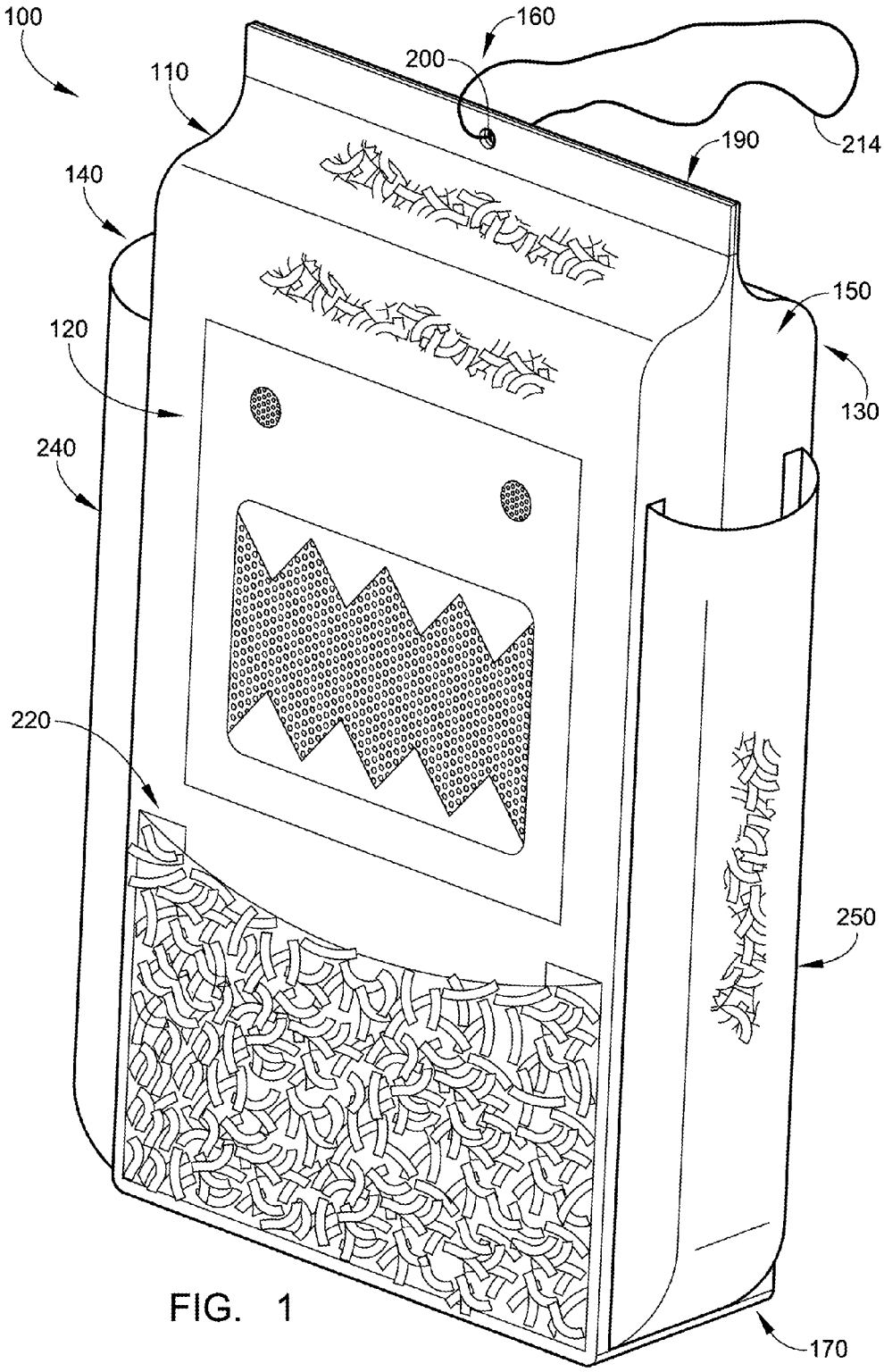
FIG. 1 is a perspective view of an embodiment of an inflatable piñata in an expanded configuration.
Figure 2:
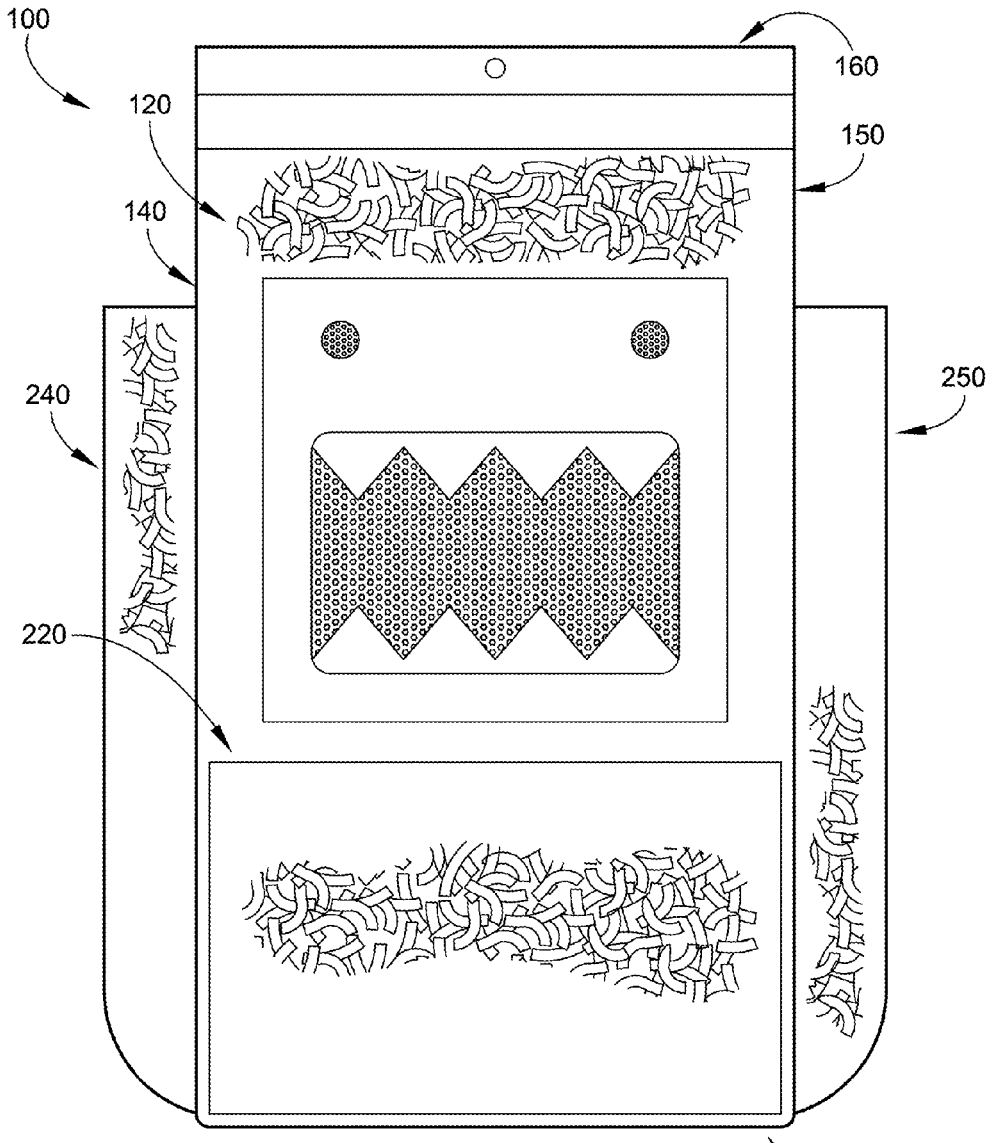
FIG. 2 is a front elevational view of the inflatable piñata of FIG. 1.
Figure 3:
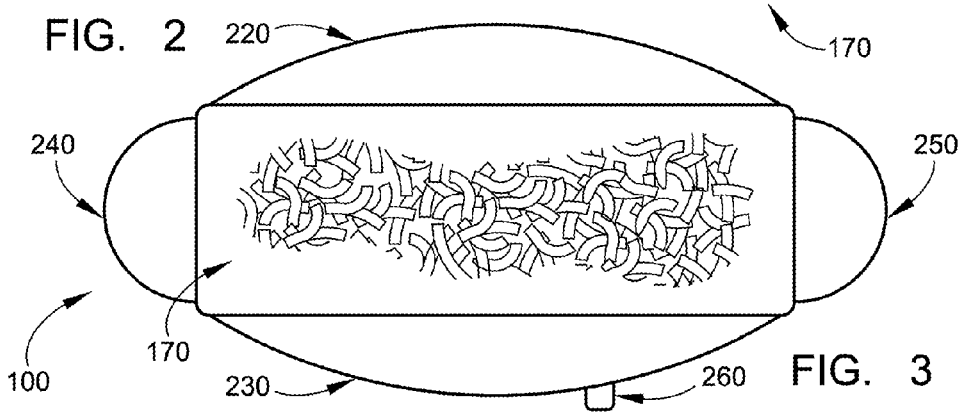
FIG. 3 is a bottom plan view of the inflatable piñata of FIG. 1.

With reference to FIG. 1, the piñata 100 preferably includes a body 110 made of a material ideal for inflatable expandable/collapsible use such as, but not limited to, polyethylene. In alternative embodiments, other types of material may be used such as, but not limited to, a high-quality polyvinyl chloride (PVC). The body 110 may have any desired construction and/or configuration for the desired final piñata design. In the embodiment shown, the body 110 includes a front wall 120, a rear wall 130, a left side portion 140, a right side portion 150, a top portion 160, and a bottom portion 170. The left side portion 140 and the right side portion 150 include respective longitudinal central seams 180. The top portion 160 includes a joinder flange 190. The joinder flange 190 includes a central hole 200 that receives a string, rope, wire, or other support 214 for supporting/hanging the piñata 100. The front wall 120 includes a front pouch 220. The rear wall 130 includes a rear pouch 230. The left side portion 140 includes a left side pouch 240. The right side portion 150 includes a right side pouch 250. The pouches 220, 230, 240, 250 hold articles, prizes, candy, nuts, etc. that are released when the piñata 100 is knocked around with a striking object.

An outer surface of the body 110 is covered or "dressed" with ornamental paper, such as paper mache or other such design so as to conceal the body 110 within. The colorful paper is preferably adhered to the outer surface of the body 110 and the pouches 220, 230, 240, 250.

Figure 4:
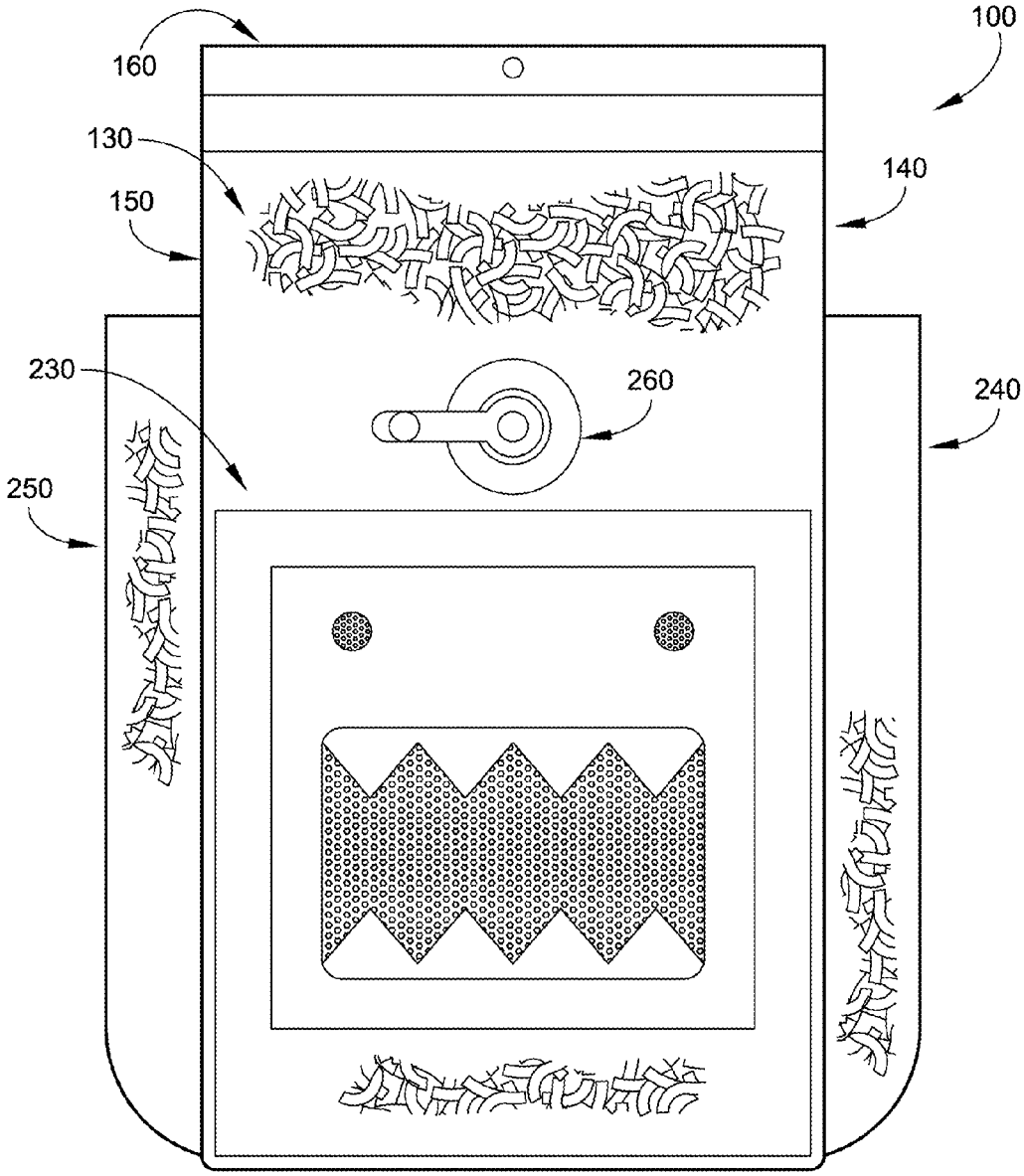
FIG. 4 is a rear elevational view of the inflatable piñata of FIG. 1.
Figure 5:
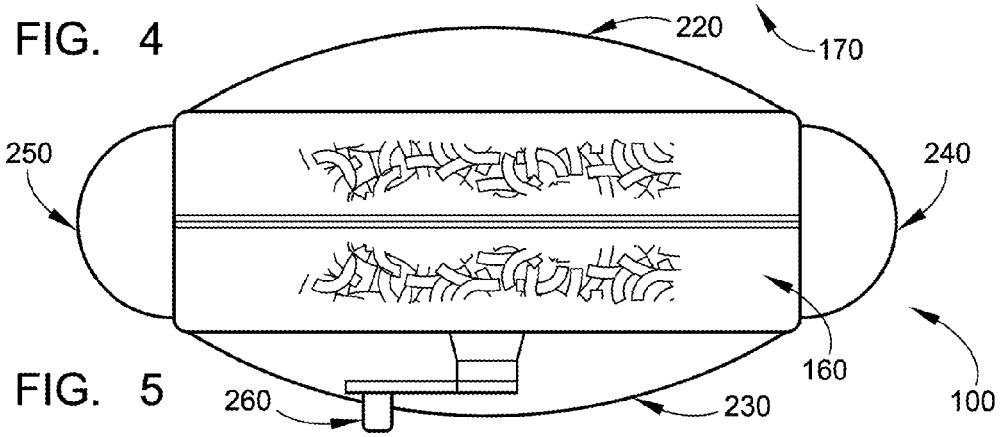
FIG. 5 is a top plan view of the inflatable piñata shown in FIG. 1.
Figure 6:
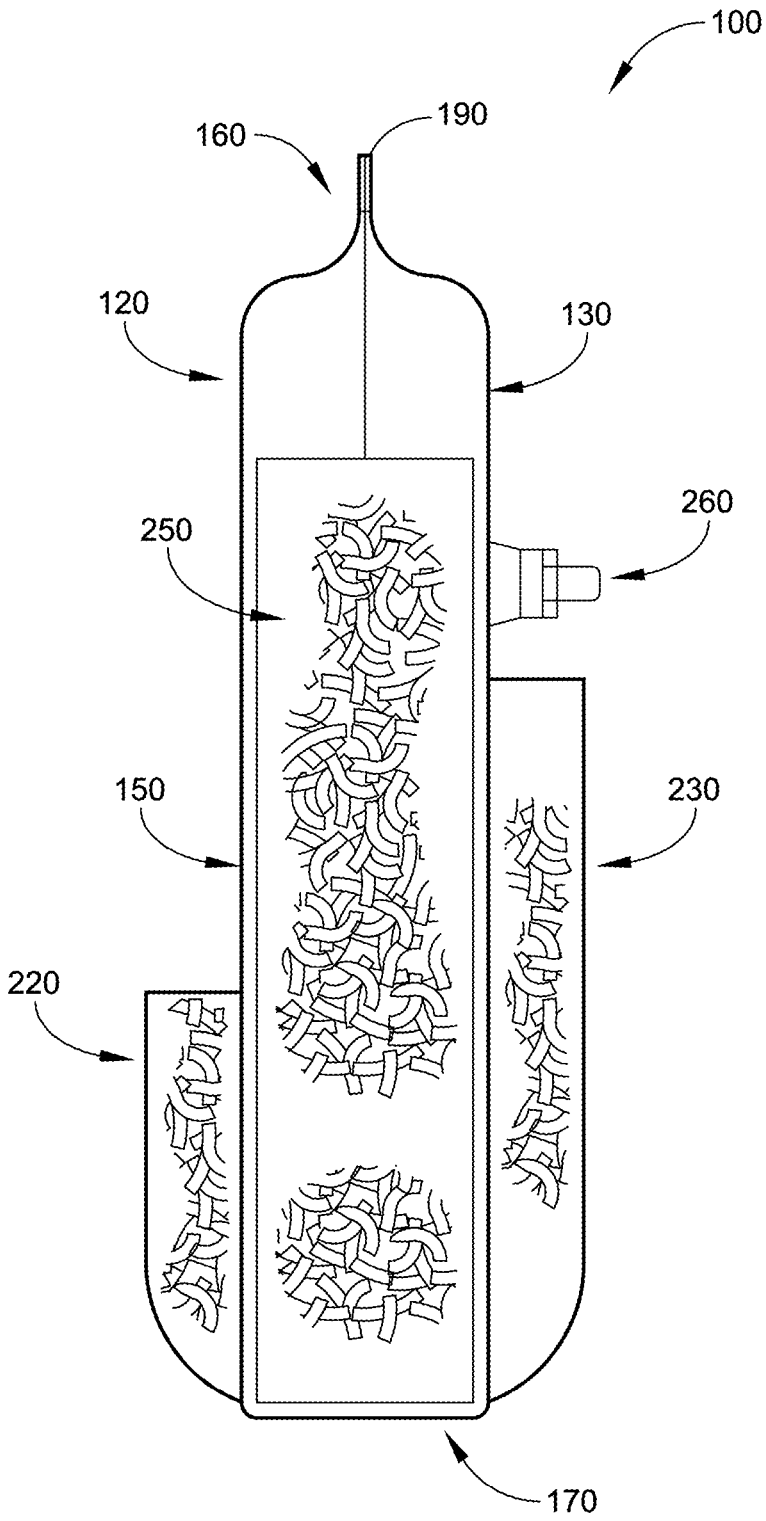
FIG. 6 is a right elevational view of the inflatable piñata of FIG. 1.

As shown in FIGS. 4 and 5, the rear wall 130 carries a valve 260 for inflating (e.g., manual inflation) or deflating the inflatable body 110/pinata 100.

In use, when the piñata 100 is deflated (e.g., during shipping/storage), the piñata 100 is compressed/collapsed into a compact, substantially two-dimensional configuration, which is an ideal configuration for storage and minimizing shipping costs.

For normal use of the piñata 100 at a party or other festive occasion, the piñata 100 is removed from shipping packaging and, when the piñata 100 is ready to be used, the piñata 100 is inflated (e.g., manually inflated) via valve 260 to the expanded configuration shown in FIG. 1 and the pouches 220, 230, 240, 250 are stuffed with articles, prizes, candy, nuts, etc. for later release when the piñata 100 is knocked around with a striking object.

In alternative embodiments, the piñata 100 is expanded/collapsed by means other than inflation/deflation.

The piñata 100/body 110 (or portions of the piñata 100/body 110) may be reinforced by one or more layers of plastic material (or other material) to strengthen the piñata 100/body 110 and/or strengthen certain areas of the piñata 100/body 110. More or less plastic reinforcement may be added to adapt the piñata 100/body 110 for different age-specific usage groups in accordance with different strength levels so that the piñata 100 does not rupture when struck by a striking object.

To manufacture the piñata 100, one or more pieces of PVC or other material are adhered (or otherwise fixed) together to form the body 110 into the desired shape and/or configuration. The PVC or other material forming the pouches 220, 230, 240, 250 are adhered (or otherwise fixed) to the front wall 120, the rear wall 130, the left side portion 140, and the right side portion 150.

In alternative embodiments, the piñata 100 may take any number of different configurations (e.g., inflatable humanoids, inflatable animals).

In further embodiments, the piñata 100 is inflatable/expandable with water. In still further embodiments, the piñata 100 is configured to be easily punctured in one or more areas so that striking the piñata 100 with an object may cause the piñata 100 to become punctured and leak or squirt water (e.g., ideal for use during hot summer days).

To dress the piñata 100, glue may be applied to the exterior side of the body 110 and paper or other material is applied to the glue.

Thus, the piñata 100 is deflatable/collapsible for reducing the piñata 100 to a small, compact, flat, substantially two-dimensional configuration that is ideal for storage and ideal for shipping because of the greatly reduced shipping costs. The piñata 100 is inflatable/expandable into a large piñata configuration for normal piñata use at a party or other festive occasion.

The above figures may depict exemplary configurations for the invention, which is done to aid in understanding the features and functionality that can be included in the invention.

The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in any following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. An inflatable piñata, comprising:

an inflatable body comprising a front wall, a rear wall, a left side portion, a right side portion, a top portion, and a bottom portion that define an exterior surface of an enclosed interior cavity of the inflatable piñata;

one or more pouches coupled to each of the front wall, back wall, left side portion, and right side portion, each pouch including a bottom seam joined to the exterior surface at a bottom end, relative to the top portion, each pouch further including side seams joined to the exterior surface at a first side and a second side, the first side opposite the second side relative to the bottom end, each pouch further including an open top defined by an uninterrupted arc extending from its first side, outward and away from the exterior surface, and returning to its second side, respectively, each pouch extending outward and away from the exterior surface between the bottom end, the first side and the second side, each pouch having a maximum extension distance along the uninterrupted arc approximately midway between its first and second side, respectively, and each pouch tapering inward and toward the exterior surface proximate its bottom end, its first side, and its second side, respectively; and a valve coupled to the inflatable body and configured for selectively inflating and deflating the interior cavity, the inflatable body being inflatably and deflatably adjustable between a first, substantially flat configuration, and a second expanded configuration.

2. The inflatable piñata of claim 1, wherein the top portion comprises a joinder flange, the joinder flange including a hole for receiving a support for suspending the inflatable piñata and the plurality of items against gravity during a piñata use.

3. The inflatable piñata of claim 1, wherein the inflatable body comprises polyethylene.

4. The inflatable piñata of claim 1, wherein the inflatable body comprises polyvinyl chloride.

5. The inflatable piñata of claim 1, wherein the left side and right side portions each comprise a longitudinal central seam.

6. The inflatable piñata of claim 1, wherein the valve is configured to manually inflate and deflate the inflatable body.

7. The inflatable piñata of claim 1, wherein the inflatable body is configured to be filled with a liquid; and wherein the valve is configured to selectively receive and emit a liquid.

8. The inflatable piñata of claim 1, further comprising one or more ornamental layers of material coupled to the inflatable body.

9. The inflatable piñata of claim 1, further comprising one or more ornamental layers of material coupled to one or more the one or more pouches.

10. The inflatable piñata of claim 1, further comprising one or more reinforcing layers of material coupled to the inflatable body.

11. A method of manufacturing an inflatable piñata comprising:

forming an inflatable body from one or more pieces of material, the inflatable body comprising a front wall, a rear wall, a left side portion, a right side portion, a top portion, and a bottom portion that define an exterior surface of an enclosed interior cavity of the inflatable piñata;

coupling one or more pouches to the exterior surface at each of the front wall, back wall, left side portion, and right side portion, including joining each of the one or more pouches to the exterior surface at one or more seams at a bottom end, a first side, and a second side, relative to the top portion, respectively, and coupling the one or more pouches such that each pouch includes an open top defined by an uninterrupted arc extending from its first side, outward and away from the exterior surface, and returning to its second side, respectively, and such that each pouch has a maximum extension distance along the uninterrupted arc approximately midway between its first and second side, respectively, and tapers inward and toward the exterior surface proximate its bottom end, its first side, and its second side, respectively; and coupling a valve to the inflatable body, the valve being configured to inflate and deflate the interior cavity, the inflatable body being inflatably and deflatably adjustable between a first, substantially flat configuration, and a second expanded configuration.

12. The method of claim 11, wherein the inflatable body is formed of a single piece of material.

13. The method of claim 11, wherein forming the inflatable body comprises forming a joinder flange on the top portion of the inflatable body, the joinder flange configured for suspending the inflatable piñata and the plurality of items against gravity during a piñata use.

14. The method of claim 13, forming a hole in the joinder flange for receiving a support for suspending the inflatable piñata.

15. The method of claim 11, wherein the inflatable body comprises polyethylene or polyvinyl chloride.

16. The method of claim 11, wherein forming the inflatable body comprises forming a longitudinal central seam on the left and right side portions.

17. The method of claim 11, further comprising coupling one or more ornamental or supporting layers of material coupled to the inflatable body.

* * * * *